US008689779B2

(12) United States Patent
Cadeau et al.

(10) Patent No.: US 8,689,779 B2
(45) Date of Patent: Apr. 8, 2014

(54) GAS BURNER

(75) Inventors: Christophe Cadeau, Strasbourg (FR); Jörn Naumann, Durbach (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1124 days.

(21) Appl. No.: 12/685,029

(22) Filed: Jan. 11, 2010

(65) Prior Publication Data

US 2010/0186730 A1 Jul. 29, 2010

(30) Foreign Application Priority Data

Jan. 23, 2009 (EP) ..... 09290054

(51) Int. Cl.
*F24C 3/00* (2006.01)

(52) U.S. Cl.
USPC ..... 126/39 E; 431/284; 431/354

(58) Field of Classification Search
USPC ..... 126/39 E, 39 R; 431/278, 284, 287, 285, 431/354
See application file for complete search history.

(56) References Cited

U.S. PATENT DOCUMENTS

| | | | | |
|---|---|---|---|---|
| 5,649,822 | A * | 7/1997 | Gertler et al. | 431/354 |
| 6,263,868 | B1 * | 7/2001 | Koch et al. | 126/39 R |
| 6,315,552 | B1 * | 11/2001 | Haynes et al. | 431/285 |
| 6,325,619 | B2 * | 12/2001 | Dane | 431/284 |
| 6,780,008 | B2 * | 8/2004 | Koch et al. | 431/354 |
| 7,291,009 | B2 * | 11/2007 | Kamal et al. | 431/284 |
| 7,802,567 | B2 * | 9/2010 | Cadima et al. | 126/39 E |
| 7,871,264 | B2 * | 1/2011 | Pryor et al. | 431/354 |
| 7,901,205 | B2 * | 3/2011 | Trochou | 431/284 |
| 2003/0075164 | A1 * | 4/2003 | Dane | 126/39 R |
| 2006/0051718 | A1 | 3/2006 | Kamal et al. | |
| 2008/0206697 | A1 | 8/2008 | Trochuo | |
| 2009/0047611 | A1 * | 2/2009 | Armanni | 431/284 |
| 2010/0206293 | A1 * | 8/2010 | Padgett et al. | 126/39 E |

FOREIGN PATENT DOCUMENTS

| | | | |
|---|---|---|---|
| EP | 1531304 | A2 | 5/2005 |
| WO | 2005080870 | A1 | 9/2005 |

OTHER PUBLICATIONS

National Search Report EP 10 15 0937 Dated Jan. 10, 2013.

* cited by examiner

*Primary Examiner* — John K Fristoe, Jr.
*Assistant Examiner* — R. K. Arundale
(74) *Attorney, Agent, or Firm* — James E. Howard; Andre Pallapies

(57) ABSTRACT

A gas burner with a burner lower part with a lower gas distribution chamber which is open at the top and a radial secondary air passage to supply secondary air to an inner region of the gas burner, and a burner upper part positioned loosely on the burner lower part and partially closing off the lower gas distribution chamber, and which includes a burner ring, in which an annular upper gas distribution chamber is configured, and which has a gas throughflow opening corresponding to the lower gas distribution chamber and connecting the lower gas distribution chamber to the upper gas distribution chamber.

20 Claims, 5 Drawing Sheets

GAS BURNER

BACKGROUND OF THE INVENTION

The invention relates to a gas burner with a burner lower part, in which a lower gas distribution chamber, which is open at the top, is configured, with a burner upper part, which can be positioned loosely on the burner lower part and partially closes off the lower gas distribution chamber, and which includes a burner ring, in which an upper gas distribution chamber is configured, and which has a gas throughflow opening corresponding to the lower gas distribution chamber and connecting the lower gas distribution chamber to the upper gas distribution chamber.

BRIEF SUMMARY OF THE INVENTION

Gas burners of the above-mentioned type are employed in gas hotplates, for example in gas hobs, which are built into a kitchen worktop, or in free-standing gas cookers. The gas burner is secured to a hob plate, also referred to as a top sheet, generally made of steel, ceramic or hard glass. In this process the burner lower part is inserted from below into an opening in the hob plate and is fixed to the hob plate in such a manner that it projects upward out of the hob plate. The burner upper part is positioned from above onto the burner lower part, it being possible to remove it and replace it without the aid of tools.

The gas burner includes a nozzle injector disposed below the hob plate, which mixes primary air with gas flowing to the gas burner, thus forming a gas/air mixture. Behind the nozzle injector the gas/air mixture flows into the lower gas distribution chamber, where the gas/air mixture is distributed as regularly as possible. The lower gas distribution chamber is located in the burner lower part and is open at the top in this. The burner upper part positioned on the burner lower part bounds the lower gas distribution chamber at the top and seals the lower gas distribution chamber off from the outside. An upper gas distribution chamber configured in the burner upper part is connected to the lower gas distribution chamber, so that the gas/air mixture can flow over from the lower gas distribution chamber into the upper gas distribution chamber. Gas outlet openings from the upper gas distribution chamber are located at least on the outer periphery of the burner ring, with a gas flame burning at these during operation of the gas burner. Secondary air, which is necessary for complete combustion of the gas/air mixture, reaches the gas flames burning on the outer periphery of the burner ring from the outside.

Additional gas outlet openings, which also branch off from the upper gas distribution chamber of the burner ring, can be located in the region of the inner periphery of the burner ring. The gas flames burning at these gas outlet openings are directed inward toward the center of the burner ring. In addition to the gas outlet openings on the burner ring, further gas outlet openings can also be located on an inner burner, which is disposed as a separate component in the center of the burner ring. This inner burner can be supplied with gas/air mixture by way of the same nozzle injector unit and the same lower gas distribution chamber, which also supply the upper gas distribution chamber of the burner ring. It is however also known for the inner burner to be supplied with gas/air mixture by means of a separate nozzle injector unit. The gas supply to the inner burner can then be controlled independently of the gas supply to the burner ring.

The gas flames burning on the inner periphery of the burner ring and the gas flames burning at the inner burner also have to be supplied with secondary air to ensure complete combustion of the gas/air mixture. The secondary air here can be supplied radially from the outside to the inner region in the center of the burner ring. In the prior art it is known for a component to be provided with radial and vertical holes for this purpose, being positioned on the burner lower part, the horizontal holes serving to supply secondary air to the inner region of the burner and the vertical holes allowing gas/air mixture to flow over from the lower gas distribution chamber into the upper gas distribution chamber. This component with holes through it is complex to produce. Also both the secondary air flowing through the radial holes and the gas/air mixture flowing through the vertical holes must overcome a considerable flow resistance.

An object of the present invention is to provide a particularly simple gas burner, which ensures that the inner region of the burner is supplied with secondary air in a particularly reliable manner.

According to the invention this object is achieved in that the burner lower part has a radial secondary air passage to feed secondary air into an inner region of the gas burner. Secondary air is thus fed into the inner region at the level of the burner lower part, not, as in the prior art, above the burner lower part. To this end the burner lower part has a secondary air passage, through which the secondary air can flow in from the outside. "Radial" here means that the flow direction of the secondary air flowing through the secondary air passage has a radial component; it can thus be directed horizontally or even obliquely upward in a radial direction.

The burner upper part preferably has a secondary air throughflow opening, which connects a chamber present in the inner region of the burner ring, in particular in the center of the burner ring, to the radial secondary air passage. The secondary air throughflow opening represents the vertical connection between the secondary air passage and the inner region of the gas burner, in which the flames of the inner burner and optionally the inwardly directed flames of the burner ring are located.

One important aspect of an exemplary embodiment of the invention is that the lower gas distribution chamber in the burner lower part is defined by a single component. This allows particularly simple production of the burner lower part, as it bounds the lower gas distribution chamber at the bottom and to the side. Using a single-part component means that no screwing or bonding processes are required to manufacture the burner lower part.

The lower gas distribution chamber has a central region and at least two, preferably three, outer regions extending outward from the central region. The outer regions are connected to one another by way of the central region. If three outer regions are provided, the lower gas distribution chamber has a Y-shape when viewed from above. The lower gas distribution chamber can however also be embodied as star-shaped with four or more outer regions.

Both the central region of the lower gas distribution chamber and the outer regions of the lower gas distribution chamber are open at the top in the burner lower part.

This means that the burner lower part is configured to be open at the top so that the entire lower gas distribution chamber is accessible vertically from above. This allows particularly simple production of the burner lower part, as no undercuts have to be made.

It is particularly advantageous for the radial secondary air passage to be formed on the outside of the burner, between two outer regions respectively of the lower gas distribution chamber. The secondary air passage is thus located outside the lower gas distribution chamber on the outside of the burner lower part. The secondary air can flow radially inward in the chamber present between the two outer regions of the lower gas distribution chamber. The number of secondary air passages here corresponds to the number of outer regions of the lower gas distribution chambers.

Each secondary air throughflow opening of the burner upper part preferably corresponds to a radial secondary air passage. The secondary air throughflow opening here opens into the radially inner end of the secondary air passage.

It is advantageous if the secondary air throughflow opening has a length of maximum 10 mm, preferably maximum 7 mm, particularly preferably maximum 5 mm, when viewed in the flow direction. The flow direction of the gas/air mixture through the secondary air throughflow opening is assumed to be vertical here. The length of the secondary air throughflow opening in the flow direction corresponds to the distance between the radial secondary air passage and the burner inner chamber. This dimension is determined by the material thickness of the component of the burner upper part in the region of the secondary air throughflow opening. The smallest possible extension of the secondary air throughflow opening in the flow direction is important to minimize the flow resistance for the secondary air. It is also expedient if each gas throughflow opening of the burner upper part corresponds to an outer region of the lower gas distribution chamber. The gas/air mixture thus flows by way of the outer regions of the lower gas distribution chamber through the gas throughflow openings into the burner upper part. The number of gas throughflow openings corresponds to the number of outer regions of the lower gas distribution chambers.

Each gas throughflow opening preferably has a length of maximum 10 mm, preferably maximum 7 mm, when viewed in the flow direction. The length in the flow direction corresponds to the vertical distance between the lower gas distribution chamber and the upper gas distribution chamber in the burner upper part. It is predetermined by the material thickness of the component of the burner upper part at the point where the gas throughflow opening is located. The smallest possible extension of the gas throughflow opening in the flow direction is important to minimize the flow resistance for the gas/air mixture. In this context it is also important for the extension of the gas throughflow opening in any direction perpendicular to the flow direction to be greater than the length of the gas throughflow opening in the flow direction.

The secondary air throughflow openings are disposed radially within the gas throughflow openings. This is because the secondary air throughflow openings open into the inner region of the burner, while the gas throughflow openings are connected to the burner ring enclosing the inner region. The secondary air throughflow openings are also disposed with an offset in the peripheral direction in respect of the gas throughflow openings. This radial offset is necessary, because the secondary air throughflow openings exit from the radial secondary air passages, while the gas throughflow openings exit from the outer regions of the lower gas distribution chamber.

According to one exemplary structural embodiment the burner upper part has a burner ring holder, which rests on the burner lower part and in which the gas throughflow openings and the secondary air throughflow openings are configured. The burner ring holder rests in a sealing manner on the burner lower part so that the entire top edge of the boundary wall of the lower gas distribution chamber is sealed off in relation to the burner ring holder. The burner ring holder here can be configured in the manner of a disk. It only has a small extension in the vertical direction.

According to one advantageous embodiment of the invention the burner ring holder has a gas supply in the center for an inner burner in the inner region. The inner burner is supplied with gas/air mixture by way of the central gas supply. The inner burner is located in the center of the burner ring and is supplied with secondary air by way of the radial secondary air passage and the secondary air throughflow openings.

According to an embodiment the burner ring rests on the burner ring holder. The burner ring and burner ring holder here are formed by two separate components, which can be made of different materials for example. This means that the use of expensive materials, such as brass for example, can be restricted to those components for which this is necessary for technical reasons or to comply with standards. A favorable aluminum alloy can be used for example for the other components of the burner upper part.

In another embodiment the burner ring and burner ring holder are configured as a common component. The number of components of the burner upper part is thus minimized. As far as is technically possible and permissible the complete burner upper part can be made of an aluminum alloy.

BRIEF DESCRIPTION OF THE DRAWINGS

Further advantages and details of the invention are described in more detail below with reference to an exemplary embodiment shown in the schematic figures, in which.

DETAILED DESCRIPTION OF EXEMPLARY EMBODIMENTS OF THE PRESENT INVENTION

Figure 1:
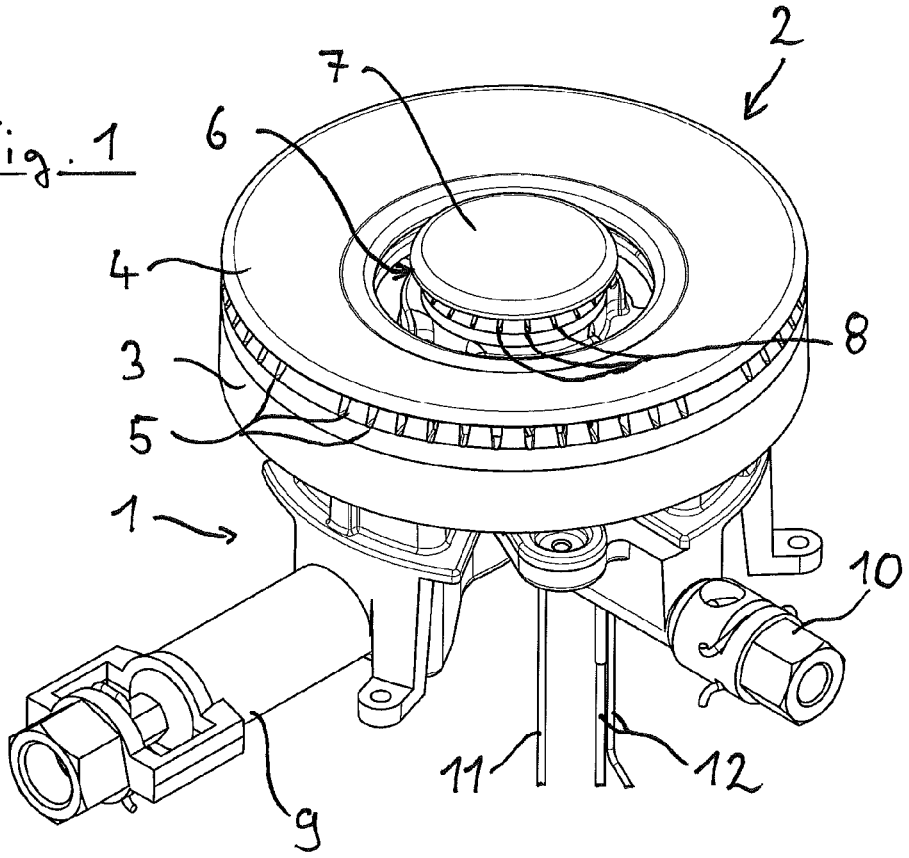
FIG. 1 shows an inventive gas burner.

FIG. 1 shows an exemplary embodiment of an inventive gas burner with a burner lower part 1 and burner upper part 2. Associated with the burner upper part 2 is a burner ring 3 with a burner cover 4 positioned on top. Gas outlet openings 5 are incorporated in the burner ring 3, at which gas flames burn during operation of the gas burner. These gas outlet openings 5 are bounded at the top by the burner cover 4. Located in an inner region of the burner ring 3 is a separate inner burner 6, which is sealed off at the top by an inner burner cover 7. The inner burner 6 also has gas outlet openings 8, at which gas flames burn during operation of the inner burner.

Associated with the burner lower part 1 is a nozzle injector unit 9, in which the gas provided for combustion is mixed with air components (the so-called primary air). The nozzle injector unit 9 serves to supply the gas outlet openings 5 on the burner ring 3. A further nozzle injector unit 10 is provided to supply the inner burner 6.

Also shown are a voltage supply line 11 for an ignition electrode of the gas burner and a signal line 12 of a thermoelement, which is employed to detect a flame present at the burner.

Figure 2:
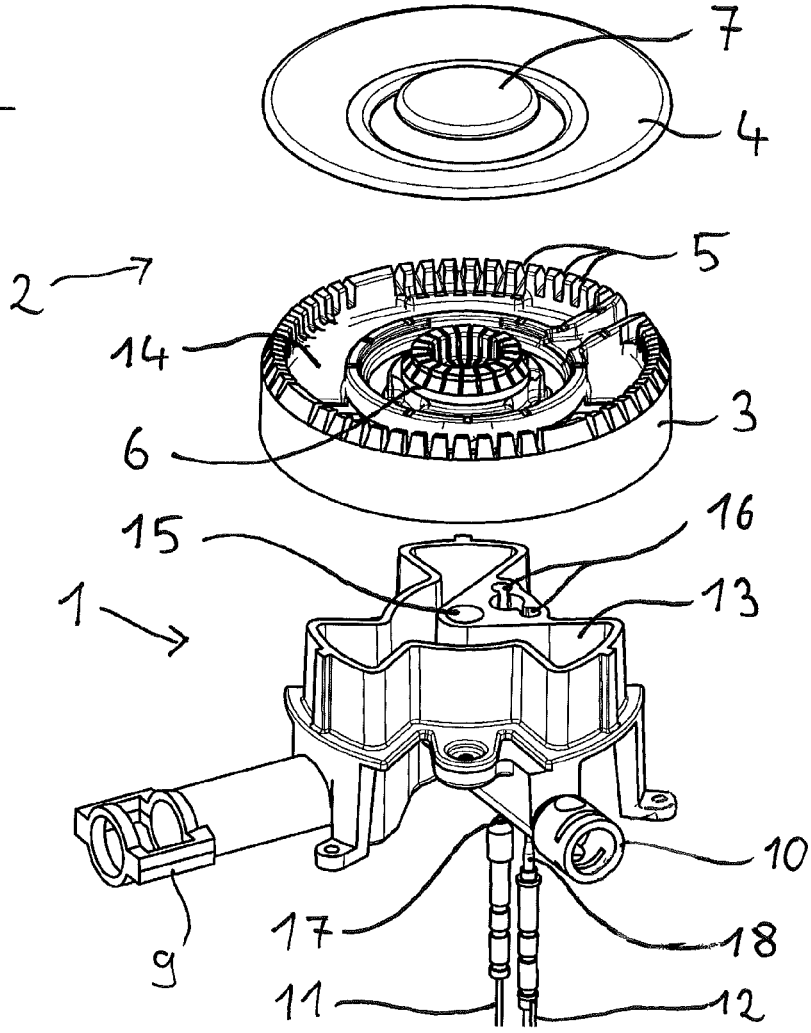
FIG. 2 shows an exploded view of the gas burner.

FIG. 2 shows an exploded view of the burner according to FIG. 1. In particular it shows the lower gas distribution chamber 13 present in the burner lower part 1, in which the gas/air mixture coming from the nozzle injector unit 9 is distributed. The gas/air mixture passes from the lower gas distribution chamber 13 into the upper gas distribution chamber 14, which is configured in the burner ring 3. In the upper gas distribution chamber 14 the gas/air mixture is distributed in a regular manner over its periphery and passes out through the gas outlet openings 5, at which the gas flames burn. The upper gas distribution chamber is closed off at the top by the burner ring cover 4.

A gas supply 15 for the inner burner 6 is incorporated in the burner lower part 1, and connects the nozzle injector unit 10 to the inner burner 6. Also in the burner lower part 1 are a receiving opening 16 for the ignition electrode 17 and the thermoelement 18.

Figure 3:
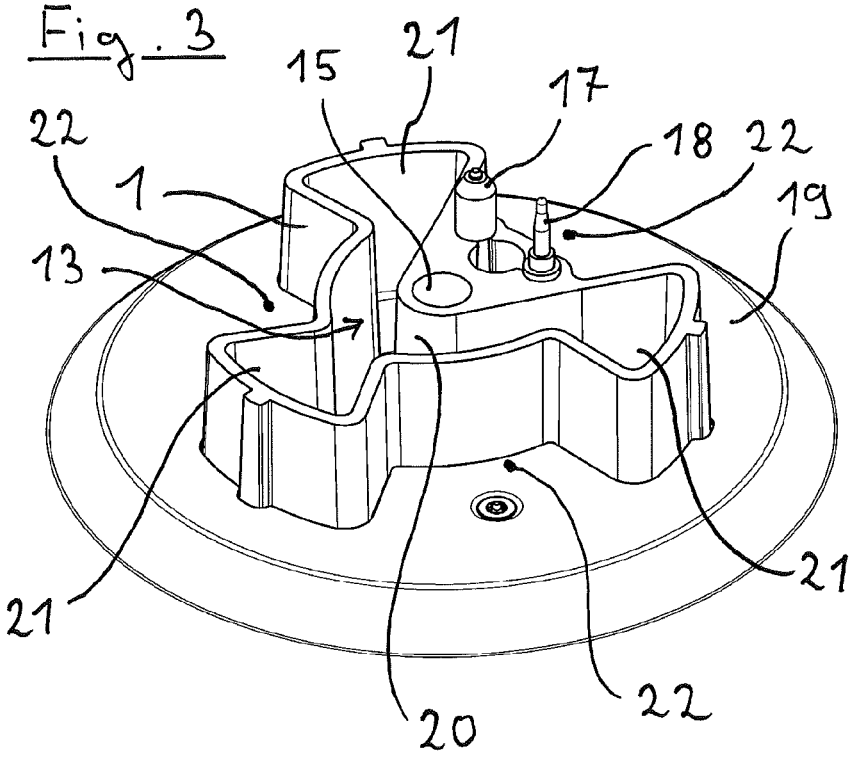
FIG. 3 shows a burner lower part of the gas burner.

FIG. 3 shows the burner lower part 1 in the assembled state. The burner lower part 1 here projects from below out of a heat shield 19, which is located directly on a hob plate (not shown). The heat shield 19 serves to protect the hob plate, which is made of hard glass for example, from the heat radiated by the gas burner. In the present exemplary embodiment the lower gas distribution chamber 13 of the burner lower part 1 is embodied as a Y-shape, with three outer regions 21 branching off a central region 20 of the lower gas distribution chamber 13. The chamber between the outer regions 21 of the lower gas distribution chamber 13 outside the burner lower part 1 serves as a radial secondary air passage 22. Secondary air from the outside can flow into the inner region of the burner through each of the, in the present exemplary embodiment, three radial secondary air passages 22. In the region of the radial secondary air passages 22 the flow direction of the secondary air has at least one radial component directed inward from the outside. The secondary air here generally flows obliquely inward and upward from the outside.

Figure 4:
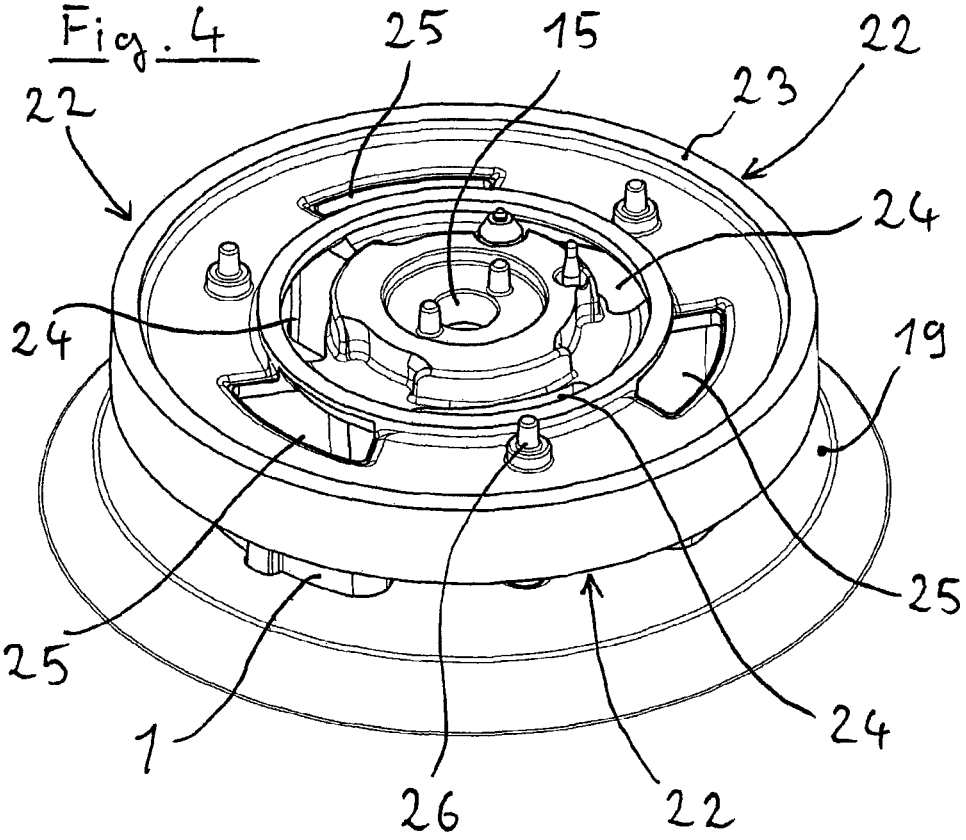
FIG. 4 shows the burner lower part with the burner ring holder on top.

FIG. 4 shows the burner lower part 1 according to FIG. 3 with a burner ring holder 23 on top. The burner ring holder 23 is part of the burner upper part 2 and is embodied as a separate component in the present exemplary embodiment. It is however also possible to embody the burner ring holder 23 and the burner ring as a common component. It can be seen that the burner ring holder 23 has three secondary air throughflow openings 24, which are connected to the radial secondary air passages 22. The secondary air can flow from the chamber outside the gas burner by way of the radial secondary air passages 22, through the secondary air throughflow openings 24 into the inner region of the gas burner, specifically into the annular chamber (see FIG. 1) present between the inner burner 6 and the burner ring 3. The flames present at the gas outlet openings 8 of the inner burner 6 are supplied with secondary air from below in this manner.

The burner ring holder 23 also has three gas throughflow openings 25, which connect the lower gas distribution chamber 13 to the upper gas distribution chamber 14 in the burner ring 3. The gas throughflow openings 25 correspond to the outer regions 21 of the lower gas distribution chamber 13. The other regions of the lower gas distribution chamber 13 are covered at the top by the burner ring holder 23.

The gas throughflow openings 25 are disposed with an offset in the peripheral direction and radially outside the secondary throughflow openings 24. The burner lower part 1 and the burner ring holder 23 thus define the flow path for the gas/air mixture, with which the burner ring 3 is supplied and the separate flow path for the secondary air, which is supplied to the inner burner 6.

Centering pins 26 serve to define the position of the burner ring 3 positioned on top of the burner ring holder 23.

Figure 5:
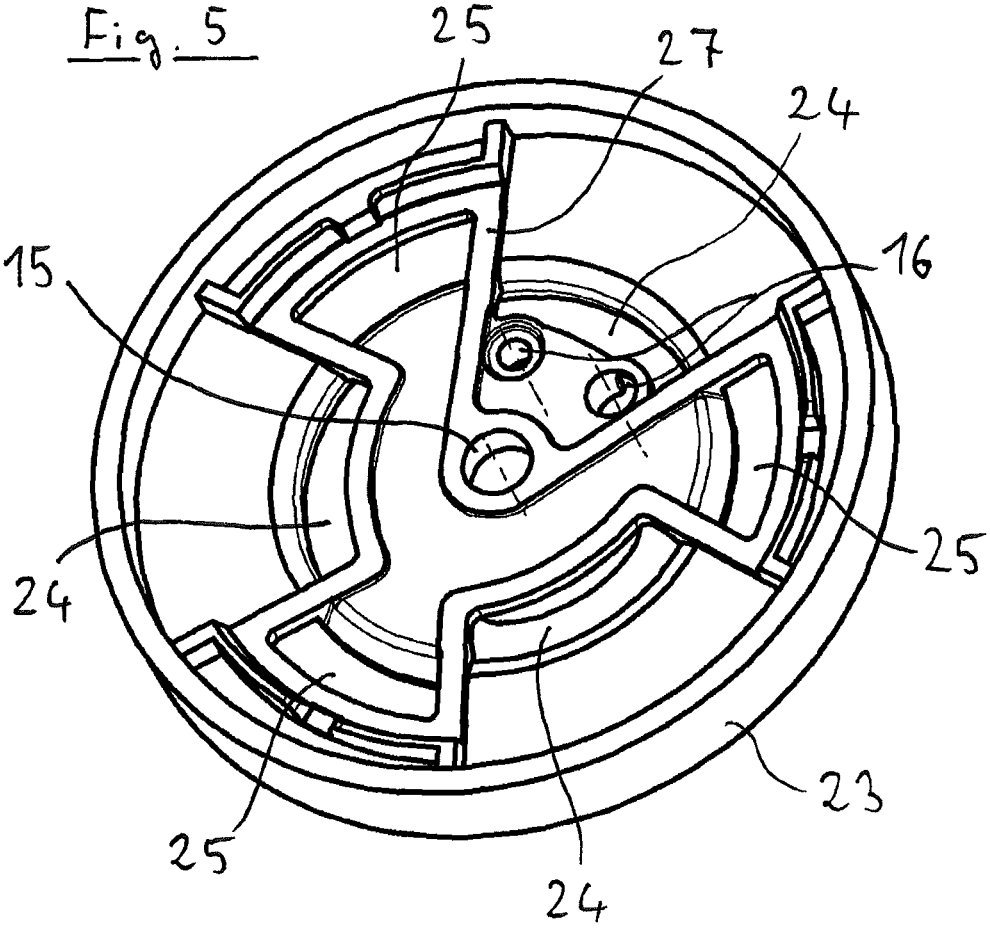
FIG. 5 shows the burner ring holder from below.

FIG. 5 shows the burner ring holder 23 from below. It also shows the secondary air throughflow openings 24 and the gas throughflow openings 25. A sealing surface 27 is provided to rest on the upper face of the burner lower part 1 and follows the contour of the lower gas distribution chamber 13 in the burner lower part 1. The sealing surface 27 is embodied as a planar, unbroken sealing surface 27. The same applies to the upper face of the burner lower part 1, which also forms a planar, unbroken sealing surface.

The invention claimed is:

1. A gas burner comprising:

a burner lower part having a lower gas distribution chamber having a central vertical axis and three outer regions, each of the outer regions extending horizontally radially away from the central vertical axis, the lower gas distribution chamber being open at its upper side including at the outer regions, and three radially located secondary air passages to supply secondary air to an inner region of the gas burner, each of the secondary air passages being located horizontally radially away from the central vertical axis and peripherally between two of the outer regions of the lower gas distribution chamber; and a burner upper part positioned loosely on the burner lower part and partially closing off the lower gas distribution chamber, the burner upper part having a burner ring in which an annular upper gas distribution chamber is configured, and three gas throughflow openings, each of the gas throughflow openings corresponding to one of the outer regions of the lower gas distribution chamber and connecting the lower gas distribution chamber to the upper gas distribution chamber.

2. The gas burner of claim 1, wherein the burner upper part includes three secondary air throughflow openings, each of the secondary air throughflow openings connecting a chamber present in the inner region of the gas burner to one of the secondary air passages.

3. The gas burner of claim 2, wherein the secondary air throughflow openings connect a center of the burner ring to the secondary air passages.

4. The gas burner of claim 2, wherein each secondary air throughflow opening of the burner upper part corresponds to one of the secondary air passages.

5. The gas burner of claim 4, wherein each of the secondary air throughflow openings has a maximum length of 10 mm, when viewed in a flow direction.

6. The gas burner of claim 4, wherein each of the secondary air throughflow openings has a maximum length of 7 mm, when viewed in a flow direction.

7. The gas burner of claim 4, wherein each of the secondary air throughflow openings has a maximum length of 5 mm, when viewed in a flow direction.

8. The gas burner of claim 2, wherein the secondary air throughflow openings are disposed with an offset in the peripheral direction with respect to the gas throughflow openings.

9. The gas burner of claim 2, wherein the burner upper part has a burner ring holder which rests on the burner lower part and in which the gas throughflow openings and the secondary air throughflow openings are configured.

10. The gas burner of claim 9, wherein the burner ring holder has a gas supply in the center for an inner burner in the inner region.

11. The gas burner of claim 9, wherein the burner ring rests on the burner ring holder.

12. The gas burner of claim 9, wherein the burner ring and the burner ring holder are formed by a common component.

13. The gas burner of claim 1, wherein the lower gas distribution chamber in the burner lower part is defined by a single component.

14. The gas burner of claim 1, wherein the lower gas distribution chamber has a central region and the outer regions extend radially outward from the central region.

15. The gas burner of claim 14, wherein the central region of the lower gas distribution chamber and the outer regions of the lower gas distribution chamber are open at the top in the burner lower part and/or the burner lower part is open at the top so that the entire lower gas distribution chamber is accessible vertically from above.

16. The gas burner of claim 1, wherein each of the gas throughflow openings of the burner upper part corresponds to one of the outer regions of the lower gas distribution chamber.

17. The gas burner of claim 1, wherein each of the gas throughflow openings has a maximum length of 10 mm when viewed in a flow direction.

18. The gas burner of claim 1, wherein each of the gas throughflow openings has a maximum length of 7 mm when viewed in the flow direction.

19. The gas burner of claim 1, further comprising an inner gas distribution chamber, the inner gas distribution chamber and the annular upper gas distribution chamber being different distribution chambers.

20. The gas burner of claim 19, further comprising an inner gas supply passage extending vertically along the central vertical axis and fluidly connecting to the inner gas distribution chamber.

* * * * *